US005709595A

United States Patent [19]

Bergner et al.

[11] Patent Number: 5,709,595

[45] Date of Patent: Jan. 20, 1998

[54] POWER TOOL FOR SURFACE TREATMENT

[75] Inventors: Joao Bergner, Leonberg; Steffen Wuensch, Holzgerlingen, both of Germany

[73] Assignee: Robert Bosch GmbH, Stuttgart, Germany

[21] Appl. No.: 771,803

[22] Filed: Dec. 20, 1996

Related U.S. Application Data

[62] Division of Ser. No. 191,002, Feb. 3, 1994, Pat. No. 5,626, 510.

[30] Foreign Application Priority Data

Apr. 2, 1993 [DE] Germany ..... 43 03 044.0

[51] Int. Cl.[6] ..... B24B 23/00

[52] U.S. Cl. ..... 451/356; 451/344; 451/357

[58] Field of Search ..... 451/344, 351, 451/356, 357, 359, 360, 162, 166, 458, 490

[56] References Cited

U.S. PATENT DOCUMENTS

| | | | |
|---|---|---|---|
| 4,478,010 | 10/1984 | Dicke | 451/356 |
| 4,624,078 | 11/1986 | Van Rijen et al. | 451/357 |
| 5,309,682 | 5/1994 | Gutknecht et al. | 451/490 |
| 5,470,272 | 11/1995 | Kikuchi et al. | 451/356 |
| 5,582,541 | 12/1996 | Hutchins | 451/357 |

*Primary Examiner*—Eileen P. Morgan
*Attorney, Agent, or Firm*—Michael J. Striker

[57] ABSTRACT

A power tool for surface treatment comprises a housing, a motor accommodated in the housing, a tool holder, a tool supported in the tool holder and driveable by the motor, the tool having a substantially triangular base surface for receiving a substantially triangular grinding sheet, the tool holder being shell-shaped and having a substantially triangular contour substantially corresponding to the base surface of the tool, and also having an outer edge abutting on the tool.

6 Claims, 7 Drawing Sheets

POWER TOOL FOR SURFACE TREATMENT

This is a division of application Ser. No. 08/191,002 filed Feb. 3, 1994 now U.S. Pat. No. 5,626,510.

BACKGROUND OF THE INVENTION

The present invention relates to a power tool for surface treatment.

More particularly, it relates to a power tool with a housing, a motor arranged in the housing, and a rotary, circulatory or swinging tool driven by the motor and having a triangular base surface for receiving a triangular grinding sheet.

Power tools of the above mentioned general type are known in the art. One of such power tools is disclosed for example in U.S. Pat. No. 3,160,994. The power tool disclosed in this reference is used for grinding of surfaces near their edges, in particular in corners or along grooves. The power tool has a grinding disc with a triangular base surface. Its working movement is performed reciprocatingly in a swinging manner around a stationary axis extending perpendicular to the base surface. The axis of the grinding disc extends geometrically close to a corner which faces forwardly. The angle of the corner in the front region of the grinding disc is smaller than 90°, and therefore the grinding disc can be used up to the outermost, edge-adjacent region of corners or grooves for grinding. In such a power tool which is further developed and has the axis extending centrally geometrically through the grinding disc, the edges of the grinding tool are curved, which is also known as flatiron, for grinding at locations which are difficult to access and flush with the edges.

The contour of the grinding disc which is formed as a unilateral triangle, similar to flatiron with curved side edges, has three corner angles, similarly to all such triangles, which corner angles are smaller than 90°.

Furthermore, power tools with rectangular grinding discs are known which are provided with an eccentric drive for performing a fixed circulatory movement. These power tools are identified as swinging discs, despite the fact that their tool does not perform a swinging movement in its exact meaning.

A further development of the swinging discs led to eccentric grinders with unfixed, circulatory and rotary grinding disc. Its movement is controllable by adjusting of several, different operational stages.

The known power tools are power-efficient, however they have relatively expensive constructions. They also have a high weight, a high energy consumption, a high noise generation and require auxiliary tools for their tool exchange, for example to exchange the grinding discs.

SUMMARY OF THE INVENTION

Accordingly, it is an object of the present invention to provide a power tool, which avoids the disadvantages of the prior art.

In keeping with these objects and with others which will become apparent hereinafter, one feature of the present invention resides, briefly stated, in a power tool which has a housing, a motor accommodated in the housing, and a rotary, circulatory or swinging tool which is driven by the motor and has a triangular base surface for receiving a triangular grinding sheet, wherein in accordance with the present invention a tool holder is provided with a shell-like base surface or contour which substantially corresponds to and cooperates with the base surface of the tool, and which is supported with its outer edge on the tool (grinding disc).

When the power tool is designed in accordance with the present invention it has simpler construction, lower noise generation, lower energy consumption, simpler manufacture, smaller movable masses, quieter and faster exchange of the tool, in particular of a grinding sheet together with the grinding disc which can be performed without auxiliary tools.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
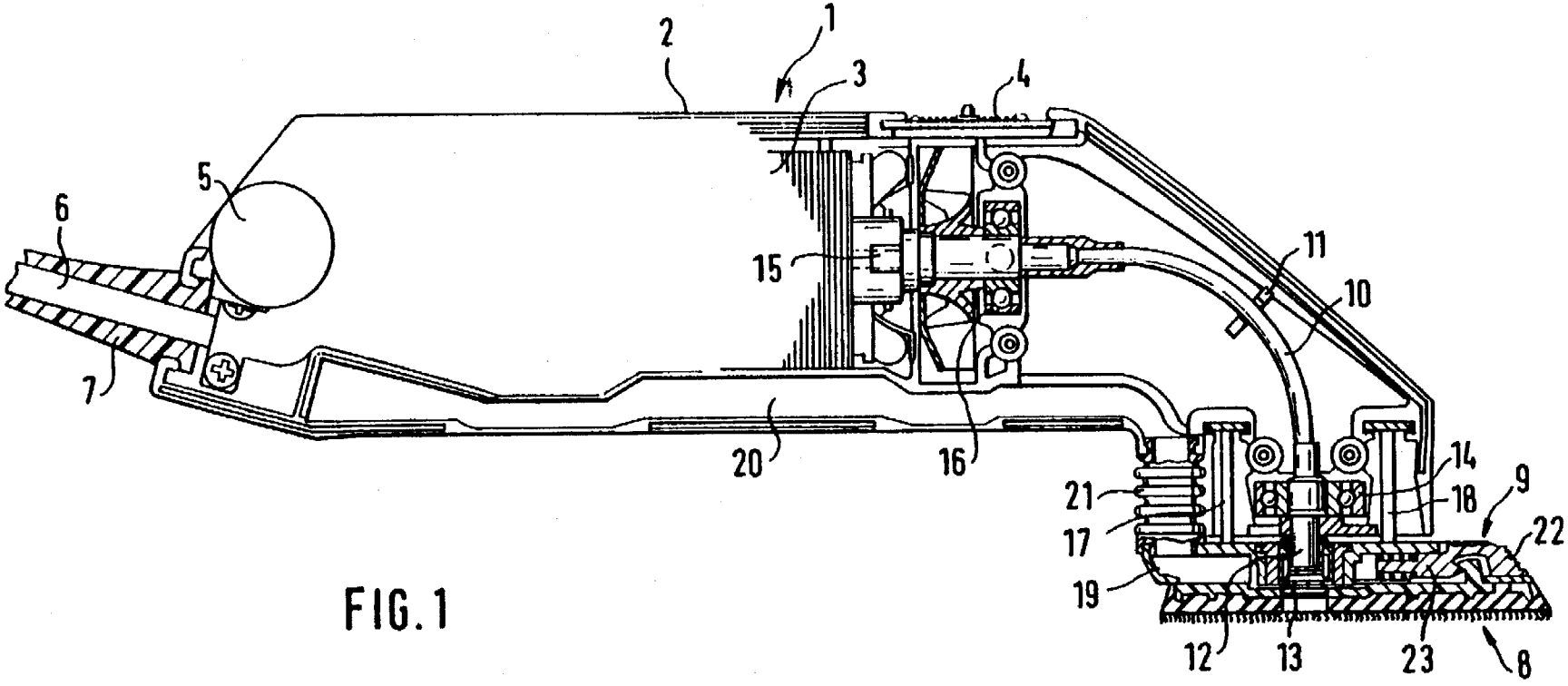
FIG. 1 is a side view of a power tool in accordance with the present invention.

An electric power tool in accordance with the present invention shown in FIG. 1 is formed as a swinging grinder 1. It has a machine housing 2 and a motor 3 arranged in the housing. An on-off switch 4 is arranged on the swinging grinder 1 for actuating by a thumb. A motor regulating wheel 5 is arranged in the rear region of the housing 2. An electric connecting conduit 6 with a protective sleeve 7 extends rearwardly from the housing 2. At the front end, the swinging grinder 1 has a grinding disc 8 for receiving not shown grinding sheets. It is mounted removably on a tool holder 9.

The rotation of the motor 3 is transmitted through a flexible shaft 10 to the tool holder 9 and thereby to the grinding disc 8. The flexible shaft 10 is guided through a lateral vibration limiting element 11 in the housing 2. One end of the flexible shaft 10 ends in an eccentric pin 12 which is rotatably supported through a needle bearing 13 on the tool holder 9 and also through a lower roller bearing 14 on the machine housing 2 near the tool holder 9. At the side facing away from the tool holder 9, the flexible shaft 10 is coupled through a plug coupling 15 with a not shown motor shaft. Moreover, the flexible shaft 10 is rotatably supported near the plug coupling 15 in an upper roller bearing 16 in the machine housing 2.

The tool holder 9 is reliably mounted through swinging elements 17 and 18 on the housing 2 to prevent its loosing and co-driving. The swinging elements are formed as sheet springs.

A bellows 21 is arranged between an opening 19 for dust discharge on the tool holder 9 and a dust transporting passage 20 in the machine housing 2 to form an elastic connecting element. Dust can be discharged through the bellows 21 without disturbing the circulatory movement of the tool holder 9.

A control button 22 is arranged in the front corner region of the tool holder 9 and is well accessible from the top and from the front. It is displaceable rearwardly and is connected integrally with a latch 23. The latch 23 which is illustrated in FIG. 3 engages in an arresting hook 24 of the grinding disc 8 and holds the grinding disc 8 on the tool holder 9.

Figure 2:
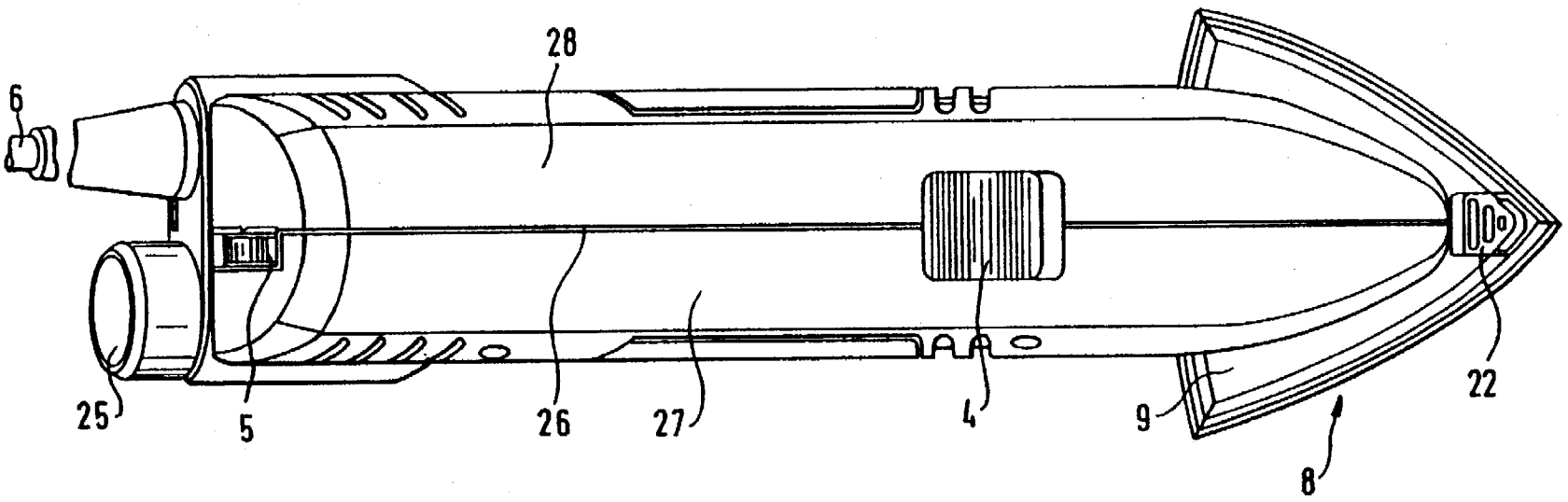
FIG. 2 is a plan view of the power tool of FIG. 1 in accordance with the invention.

The above described individual elements can be clearly seen on the top view of FIG. 2 with the control button 22, the triangular tool holder 9 with the grinding disc 8, the on-off switch 4, the electrical connecting conduit 6 and the motor regulating wheel 5. FIG. 2 in addition to FIG. 1, also illustrates a passage outlet 25 and a separating joint 26 between two asymmetrical semi-shells 27 and 28 of the housing 2.

Figure 3:
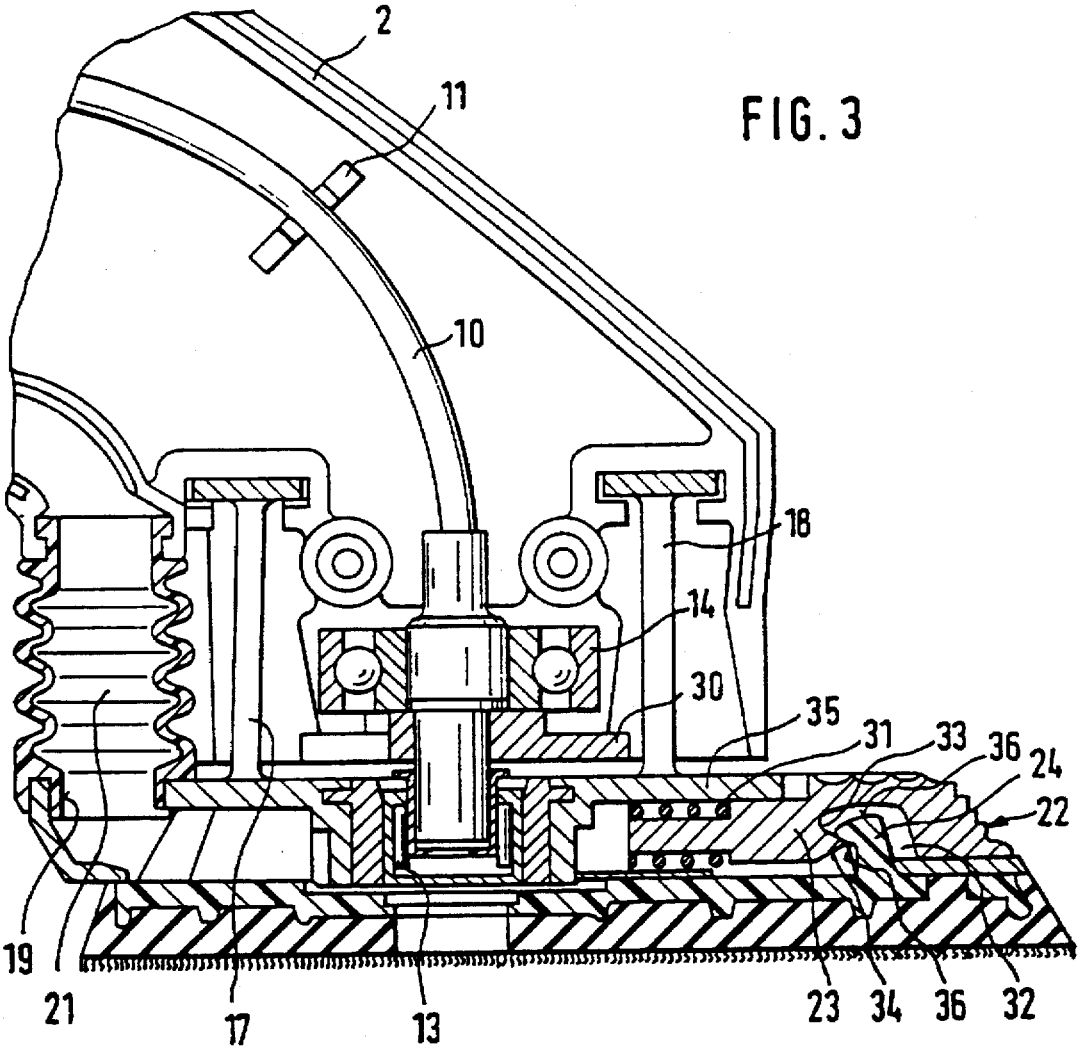
FIG. 3 is a view showing an enlarged section of a front region of the inventive power tool of FIG. 1.

In FIG. 3 the above described elements can be easily recognized. In particular, it clearly shows the housing 2, the flexible shaft 10, the rear and front swinging elements 17, 18, the bellows 21, the lower roller bearing 14 and the eccentric pin 12. In addition to the parts shown in FIGS. 1 and 2, FIG. 3 also illustrates a needle bearing 29 between the tool holder 9 and the eccentric pin 12, a compensating mass 30 arranged on the eccentric pin 12 for reducing the imbalance produced during the eccentric movement of the tool holder 9 with the grinding disc 8.

The design and the operation of the shell-like tool holder 9 and the control button 22 are as follows. The control button 22 is supported so that it is rearwardly displaceable under the action of the force of a pressure spring 31. At the side facing the grinding disc 8, the control button 22 is provided with a recess 32 with two inclined surfaces 33 and 34 in its lateral left contour, so as to form a dove-tail tip. A similar tip of an arresting hook 24 is located opposite to this tip and formed integrally on a fixed grinding disc plate 35. The arresting hook 24 carries two counter inclines 36 and 37. The upper inclined surface 33 of the latch 23 or the control button 22 engages the arresting hook 24 and is pretensioned against the lower contour incline 37, so as to stabilize the locking of the grinding disc 8 on the tool holder 9. Therefore in the tensioned condition, the grinding disc 8 is firmly pressed against the tool holder 9. Moreover, under the action of the lower inclined surface 34 during mounting of the grinding disc 8 on the tool holder 9, the control button 22 must not be displaced rearwardly since the arresting hook 24 slides on the latch 23 displaces it automatically back and engages over it.

Figure 4:
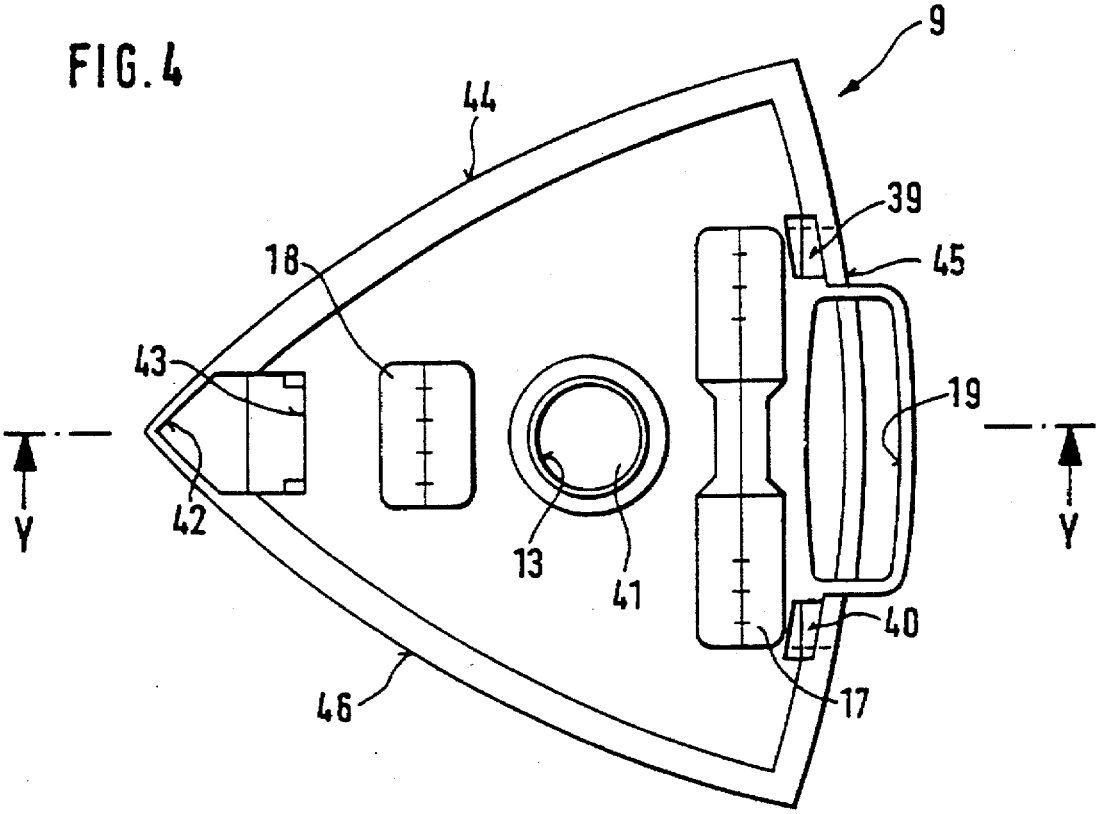
FIG. 4 is a plan view of a tool holder of the inventive power tool.

FIG. 4 shows the plan view of the tool holder 9 with the swinging elements 17, 18, and the opening 19 of the dust transporting passage 20, as well as two engaging openings 39, 40, an opening 41 for the needle bearing 13 or for the eccentric pin 12, and an opening 43 in a front corner 42 for receiving the control button 22.

Figure 5:
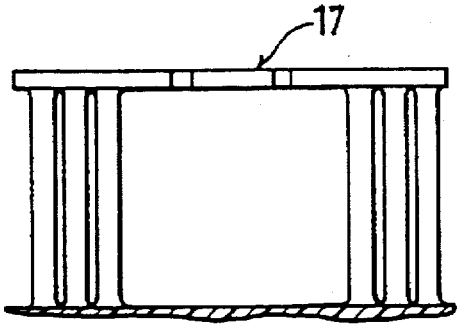
FIGS. 5 and 6 are views showing swinging elements of the tool holder of FIG. 4.
Figure 6:
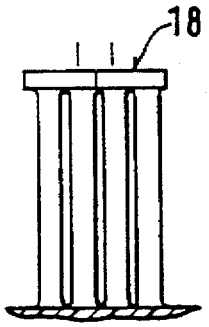

FIGS. 5 and 6 show details of the swinging elements 17 and 18. It can be seen that the rear swinging element 17 includes two groups of swinging columns each composed of three individual swinging columns, while the front swinging element 18 includes four individual swinging columns.

Figure 7:
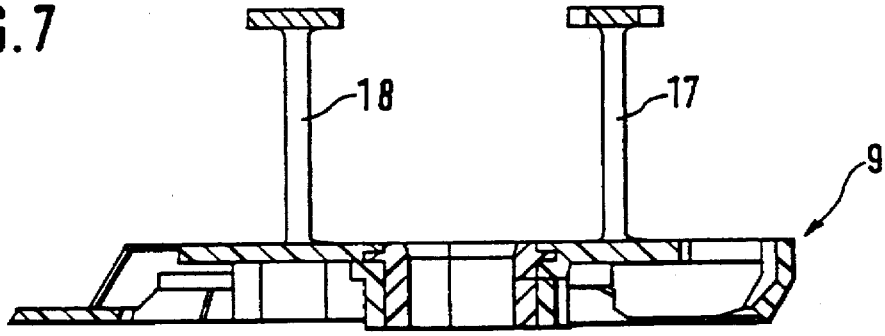
FIG. 7 is a side view of FIG. 4 and in particular of the swinging elements.

FIG. 7 illustrates the arrangement of the swinging elements 17 and 18 on the tool holder 9. It shows the side view of FIG. 4 along the section line of the arrow Y—Y, a T—profile of the swinging elements 17, 18, with their upper transverse sheets form-lockingly arranged in corresponding recesses of the housing 2 which are not shown in the drawings.

Figure 8:
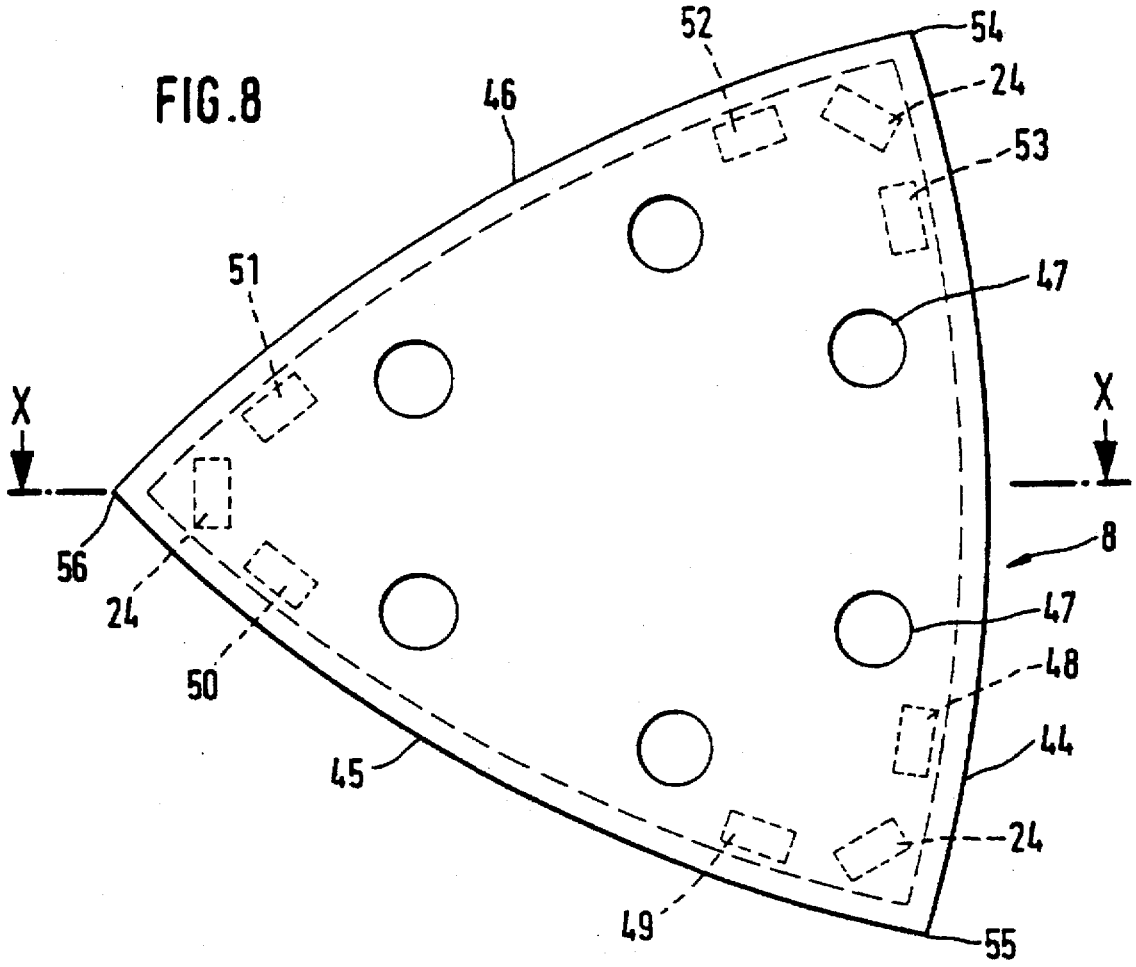
FIG. 8 is a view of the grinding disc of the inventive power tool from below.

FIG. 8 shows a view of the grinding disc 8 from below and clearly illustrates its triangular base contour with outwardly curved side edges 44, 45, 46. Moreover, it illustrates the arrangement of suction openings 47 on a common partial circle and supporting claws 48, 49, 50, 51, 52, 53, on FIG. 9 or three arresting hooks 24 near the grinding disc corners 54, 55, 56. The arrow X—X shows the direction of the section for FIG. 9.

Figure 9:
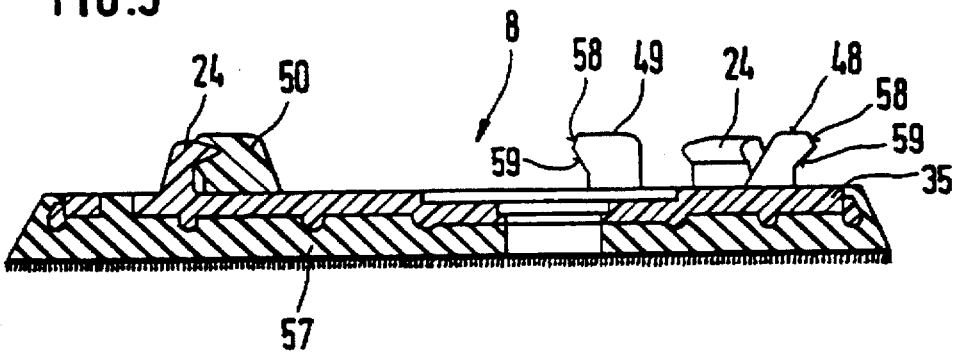
FIG. 9 is a side view of the grinding disc of the inventive power tool of FIG. 8, in section.

FIG. 9 shows a side view of the grinding disc 8 along the arrow X—X of FIG. 8. It can be seen that the grinding disc 8 includes a grinding disc plate 35 composed for example of rigid, synthetic plastic material, and a grinding disc pad 57 composed for example of soft, elastic, synthetic plastic material. The grinding disc 8 on its lower side is provided with a not shown burdock connecting system with hooks engageable with velour backs of not shown grinding sheets or other tools.

The grinding disc plate 35 at its side facing the tool holder 9 is provided in each grinding disc corner 54, 55, 56 with mirror-symmetrical opposite supporting claws 48, 49, 50, 51, 52, 53 and with arresting hooks symmetrically distributed over diagonals. The supporting claws have supporting or holding surfaces 58, 59 which extend to a tip and are inclined outwardly. The arresting hooks 24 also have counter-inclines 36, 37 which extend to a tip and face inwardly to a center of the grinding disc 8, for arresting the latch 23 of the control bottom 22 (FIG. 3).

Since the grinding disc 8 has a completely symmetrical construction, it can be arranged with its grinding disc corners 54, 55, 56 in any position relative to the corners of the tool holder. The operation of the supporting claws 48, 49, 50, 51, 52, 53 can be performed alternatingly, in particular for engaging in the engaging opening 39, 40 of the tool holder 9 and thereby fixing the grinding disc 8 on the tool holder 9 in a hinge-like manner, or for using the supporting claws as elastic spacer springs to slide on the supporting inclines 62, 63, 64, 65 of FIG. 12 and holding the grinding disc 8 with prestress against the tool holder 9.

Figure 10:
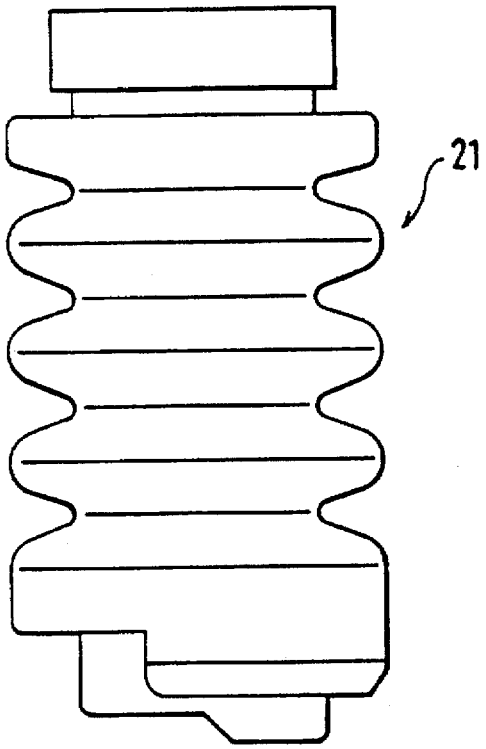
FIG. 10 is a bellows which can be coupled with the tool holder of the inventive power tool for dust aspiration.

FIG. 10 shows the bellows 21 of FIGS. 1 and 3 on an enlarged scale. The bellows 21 has a flat, rectangular cross-section corresponding to the opening 19 of FIG. 2.

Figure 11:
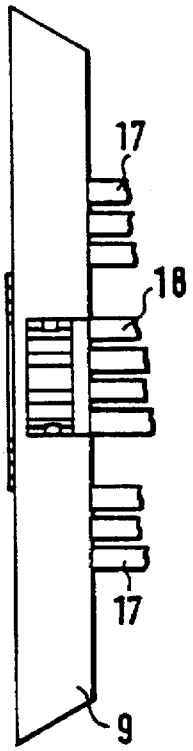
FIG. 11 is a side view of the tool holder from the side of the bellows of the inventive power tool.
Figure 12:
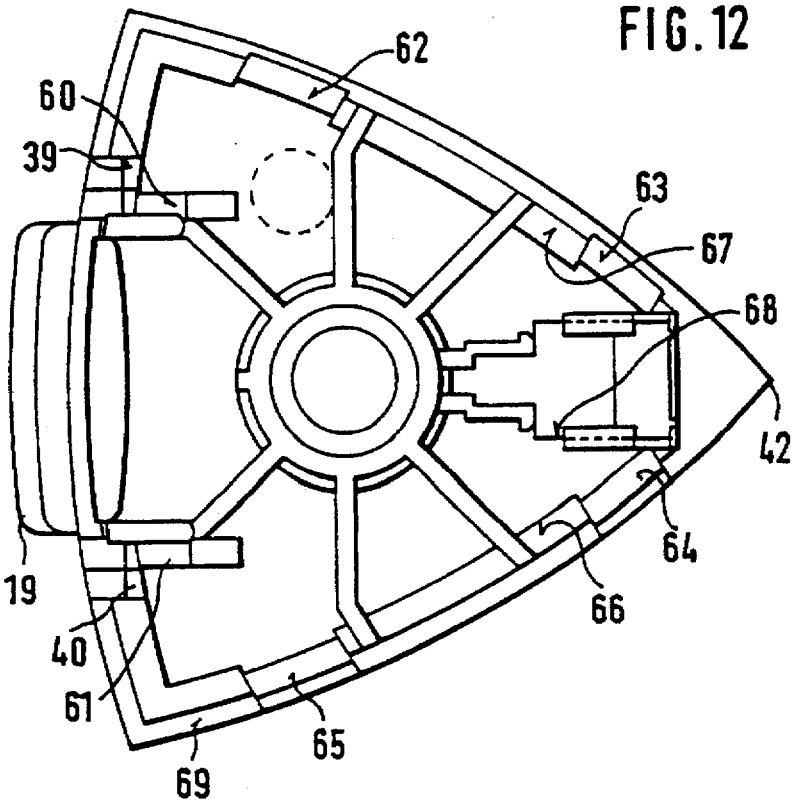
FIG. 12 is a view of the tool holder of the inventive power tool from below.

FIGS. 11 and 12 show a view of the tool holder from its rear side or from below. It illustrates the symmetrical arrangement of the swinging elements 17, 18 which cannot be seen from FIGS. 4–7. Moreover, it shows cams 60 and 61 which cooperate with the supporting claws 48, 49, 50, 51, 52, 53, and a play-free mounting of the grinding disc 8 on the tool holder 9. Supporting inclines 62, 63, 64, 65 have the same purpose and are arranged inside on the side surfaces 66, 67 of the tool holder 9 slidingly on the supporting claws 48, 49, 50, 51, 52, 53 for clamping between the grinding disc 8 and the tool holder 9 to provide a play-free arrangement.

Furthermore, a displacement guide 68 for receiving the control bottom 22 can be seen from below.

Figure 13:
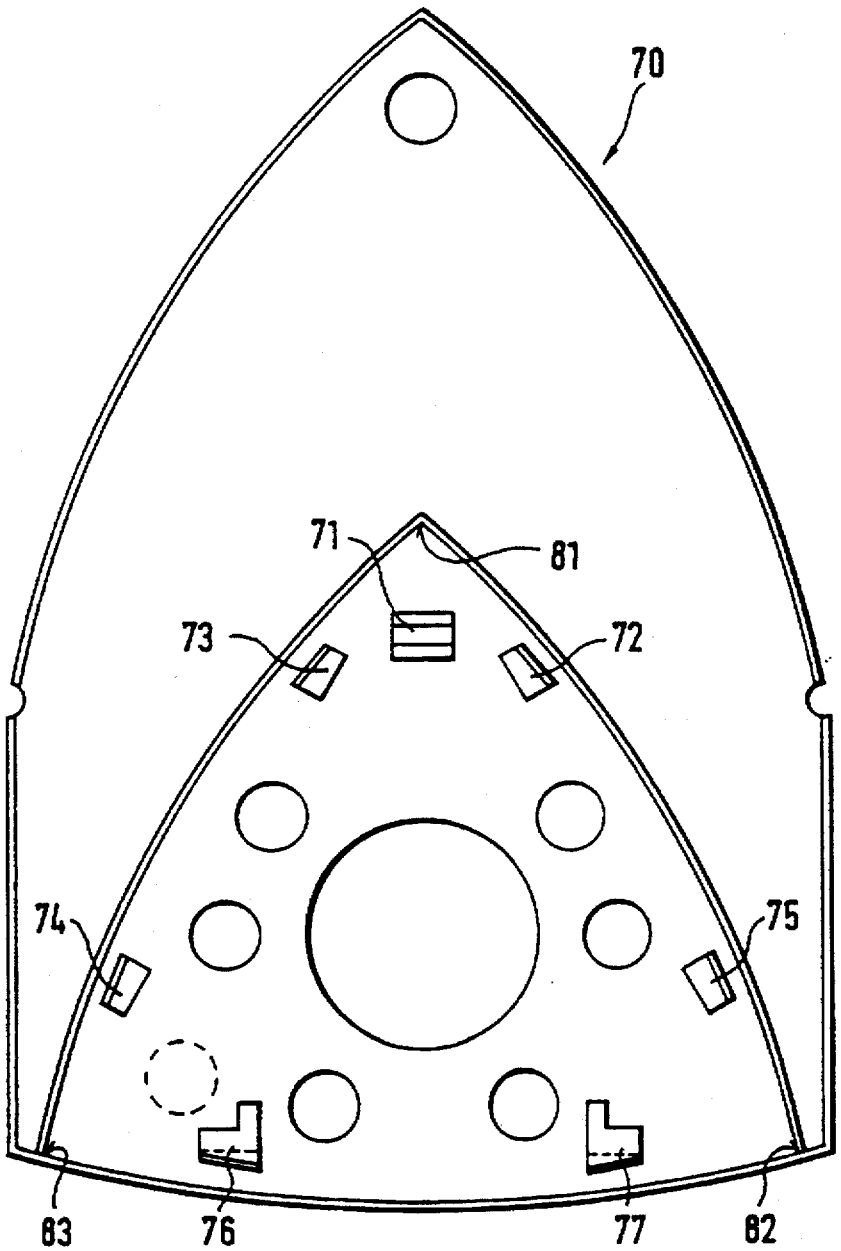
FIG. 13 is a plan view of a further embodiment of a grinding disc of the inventive power tool.
Figure 14:
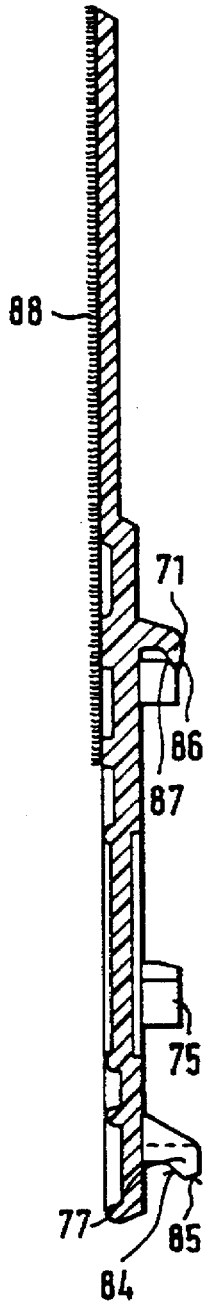
FIG. 14 is a side view of the grinding disc of FIG. 13.

FIGS. 13 and 14 show a special grinding disc 70. The special grinding disc 70 at its side facing the tool holder carries, analogously to the grinding disc 8 of FIGS. 8, 9, mirror-symmetrical oppositely located supporting claws 72, 73, 74, 75, 76, 77 at each inner contour corner 81, 82, 83, and also arresting hooks 71 symmetrically distributed along diagonals. The supporting claws 72, 73, 74, 75, 76, 77 have outwardly extending, dove-tail shaped inclined supporting and holding surfaces 48, 85. The arresting hooks 71 have inner counter-inclines 86, 87 facing the center of the grinding disc 70 and provided for engaging the latch 23 of the control bottom 22 of FIG. 3.

The grinding disc 70 due to its asymmetrical construction can be coupled only in the longitudinal direction with the tool holder 9, since only its forwardly extending region is provided for grinding, and not the region located directly under the tool holder 9 as in the embodiment of FIGS. 8, 9. The arrangement of the forwardly extending burdock connection region 88 can be clearly seen as well.

The grinding disc 70 of FIGS. 13, 14 is therefore designed so as to perform grinding in narrow intermediate spaces, for example lamellas of window louvers, doors, or for example heating or heating body ribs located close to one another.

After turning on of the motor 3 by the on-off switch 4, the motor shaft starts rotating and thereby rotates the flexible shaft 10 with the eccentric pin 12. The tool holder 9 which is secured by the swinging elements 17, 18 in the machine housing 2 at a safety distance from rotation and loosing, performs an elliptic circulatory movement which is followed by the eccentric pin 12. Since the elliptic movement is oriented longitudinally forwardly, the 44, ed outer edges 44, 45, 46 of the grinding disc 8 or the grinding sheet perform especially well the treatment of edges or grooves or other regions on workpieces which are difficult to access, flush and near the edges.

The grinding disc 8 which can be releasable by the control button 22 without an auxiliary tool can be replaced with another, not shown grinding disc provided with grinding sheets of different grain sizes or can be replaced with a special grinding disc 70 of FIGS. 13, 14 in a simple, and fast fashion. Time consuming releasing of the burdock connection between the grinding disc 8 and the grinding sheet is dispensed with, since the respective grinding sheet can remain on its grinding disc. As a result, it is possible to perform grinding treatments of surfaces having different surface qualities in a convenient manner in alternating order.

For improving the observation of the surfaces or edges to be treated and for controlling the swinging grinder 1, it is advantageous to form the grinding disc 8 and/or the tool holder 9 as a truncated pyramid extending over its base surface, in particular a common, flush pyramid frustrum. Thereby, the outermost edges of the grinding sheet are always located in a field of observation of the user of the swinging grinder.

Since the passage outlet 25 for withdrawal of grinding dust or the like is arranged asymmetrically at the rear end of the machine housing 2 in a machine housing-shell half 27, the passage outlet 25 can be produced with high accuracy. Thereby hoses or other elements for withdrawal of dust can be connectable with it tightly and reliably to prevent undesired losses.

In a not shown embodiment of the invention, instead of the grinding disc 80 or 70 of FIGS. 8 or 13, a respective matching cutting sheet is clamped analogously to the mounting of the above mentioned grinding disc. Such a cutting sheet can be used for separating floor lining and carpets from their substrates.

In accordance with another not shown embodiment of the invention, instead of a grinding disc, a scraper and/or a saw can be mounted on the tool holder.

In a still further not shown embodiment of the invention, the tool holder with the grinding disc can be supported in an arrestable hinge on the machine housing, so that the grinding disc plane or the like is turnable for adjusting the swinging grinder to angular workpieces which are difficult to access.

It will be understood that each of the elements described above, or two or more together, may also find a useful application in other types of constructions differing from the types described above.

While the invention has been illustrated and described as embodied in a power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. A power tool for surface treatment comprising:

(a) a housing;

(b) a motor mounted in the housing;

(c) a tool holder mounted by the housing for oscillating motion;

(d) drive means in the housing connecting said motor with said tool holder for imparting powered oscillating motion to the latter;

(e) a control button mounted by said tool holder for sliding movement between first and second positions, said control button having a latch formation thereon;

(f) biasing means carried by the tool holder and engaged with said control button for urging the same outwardly of the tool holder and toward said first position;

(g) at least one fixed formation on said tool holder in spaced relationship with said control button; and (h) a polygonally shaped grinding disc plate having connecting means on one face thereof for detachable engagement with cooperating connecting means formed on one face of a grinding sheet, said disc plate having a first formation and at least one second formation on a face thereof opposite said one face, said first formation and said at least one second formation being configured for detachable interengagement with said latch formation and said at least one fixed formation, respectively, whereupon manual movement of said control button from said first position toward said second position serves to disengage said latch formation from said first formation to permit detachment of the grinding disc plate from the tool holder.

2. The power tool according to claim 1 wherein said at least one fixed formation and said at least one second formation cooperate in a hinge-like manner during attachment and detachment of the disc plate.

3. The power tool according to claim 1 wherein said latch formation extends in a first direction generally outwardly of the tool holder and wherein said first formation on the disc plate extends in a second direction opposite said first direction.

4. The power tool according to claim 1 wherein said control button extends through an opening in said tool holder.

5. The power tool according to claim 1 further defined by:

(a) means defining a dust transport passageway on said housing;

(b) said tool holder having an opening cooperating with said disc plate to define a dust receiving space;

(c) said disc plate having a plurality of suction openings therethrough; and (d) passageway means communicating said dust transport passageway with said opening while accommodating oscillating movement of said tool holder.

6. The tool holder according to claim 5 wherein said passageway means comprises a bellows.

* * * * *